United States Patent [19]

Nortoft

[11] Patent Number: 4,706,726

[45] Date of Patent: Nov. 17, 1987

[54] ELECTRIC CONTROL OF VENETIAN BLIND

[75] Inventor: Soren B. Nortoft, Virum, Denmark

[73] Assignee: V. Kann Rasmussen Industri A/S, Soborg, Denmark

[21] Appl. No.: 899,296

[22] PCT Filed: Jan. 9, 1986

[86] PCT No.: PCT/DK86/00003

§ 371 Date: Aug. 13, 1986

§ 102(e) Date: Aug. 13, 1986

[87] PCT Pub. No.: WO86/04109

PCT Pub. Date: Jul. 17, 1986

[30] Foreign Application Priority Data

Jan. 10, 1985 [DK] Denmark ..... 114/85

[51] Int. Cl.[4] ..... E06B 9/30

[52] U.S. Cl. ..... 160/168 R; 160/DIG. 17; 318/257

[58] Field of Search ..... 160/168 R, 171, 176 R, 160/DIG. 17, 1; 318/257, 268, 265, 266, 306, 317, 484, 282

[56] References Cited

U.S. PATENT DOCUMENTS

| | | | |
|---|---|---|---|
| 3,249,148 | 5/1966 | Zablodil et al. | 160/176 X |
| 3,308,873 | 3/1967 | Dotto | 160/176 |
| 3,310,099 | 3/1967 | Hunter et al. | 160/171 |
| 3,559,024 | 1/1971 | Mader | 160/168 |
| 3,603,372 | 9/1971 | Dietzsch | 160/168 |
| 3,617,815 | 11/1971 | Foldvari | 318/484 X |
| 3,646,985 | 3/1972 | Klann | 160/168 |
| 3,809,143 | 5/1974 | Ipekgil | 160/168 |
| 3,835,911 | 9/1974 | Horst et al. | 160/168 |
| 3,942,114 | 3/1976 | Keeling | 318/317 X |
| 3,984,740 | 10/1976 | Wright | 318/268 |
| 4,096,903 | 6/1978 | Ringle | 160/176 R |
| 4,173,721 | 11/1979 | Louis | 160/176 R X |
| 4,295,080 | 10/1981 | Fujita et al. | 318/257 |
| 4,492,908 | 1/1985 | Stockle et al. | 160/DIG. 17 |
| 4,550,759 | 11/1985 | Archer | 160/DIG. 17 X |
| 4,585,981 | 4/1986 | Zintler | 318/266 X |
| 4,644,990 | 2/1987 | Webb et al. | 160/176 R X |

FOREIGN PATENT DOCUMENTS

| | | |
|---|---|---|
| 144894B | 6/1982 | Denmark . |
| 1683007 | 7/1966 | Fed. Rep. of Germany . |

*Primary Examiner*—Ramon S. Britts
*Assistant Examiner*—David M. Purol
*Attorney, Agent, or Firm*—Lane & Aitken

[57] ABSTRACT

For the purpose of giving the user of an electric control of a venetian blind in a window the possibility of adjusting the angular position of the slats independently of raising or lowering the venetian blind by utilizing an electric motor, spring clutches, and corresponding lift cords, the electric control includes a control circuit with a three position switch controlled by the user. The control circuit is arranged so as to drive the motor at a low speed during a first predetermined time interval for adjusting the angle of the slats and thereafter to drive the motor at an increased speed for raising or lowering the venetian blind.

9 Claims, 2 Drawing Figures

ELECTRIC CONTROL OF VENETIAN BLIND

BACKGROUND OF THE INVENTION

1. Field of the Invention

This invention relates to an electric control of Venetian blind, and of the kind comprising a Venetian blind with head rail, lower list, slats, a drive mechanism with a number of spring clutches for driving a corresponding number of ladder tapes and lift cords and a reversible electric motor for driving a drive shaft of said spring clutches.

2. Discussion of the Related Art

A spring clutch of the above-mentioned kind is known from German Patent Specification No. 1,683,007 and is ordinarily used on Venetian blinds that are operated manually by means of a pull cord. Said spring clutch comprises a drum around which the lift cord of a Venetian blind is wound and which serves to raise or lower said lower list, and a drum around which a specially designed helical spring is wound, the ends of said spring being in engagement with lugs on a ladder tape, said spring being arranged in such a way that by operating the pull cord it is possible to adjust the slats in almost vertical position. By continued pulling action on the pull cord, the lower list may then be raised or lowered.

Since there is a direct mechanical link between the two drums of the spring clutch, the two movements, i.e., the adjustment of the angle and the raising (or lowering), being simultaneously. By proper dimensioning of the diameters of the drums, it is however possible to cause the angle adjustment to occur quicker than the raising or lowering movement itself.

From, e.g., Danish Patent Specification No. 144 894 it is known per se to provide a Venetian Blind with an electric motor for maneuvering said Venetian blind.

By only associating an electric motor with said spring clutches in a control device as defined above one would of course obtain an electrical maneuvering of said Venetian blind, but the two operating steps, i.e. adjustment of the angle of the slats and the raising or lowering are still concomitant, which makes it difficult for the user to effect angular adjustment independently of the raising or lowering.

From U.S. Pat. No. 3,310,099, an electric control of a Venetian blind is known, which comprises essentially an electric unit for manual operation and a mechanism, the particular purpose of which is to ensure parallel guiding of the lower list during its movement up and down and to avoid the lift cords from being paid out in a disorderly fashion when the pulling action due to the lower list weight ceases as some part, such as furniture, interferes with the free movement of the lower list. The mechanism is furthermore so arranged that when the lower list is in its lowermost position, the user is able to perform adjustment of the angle of the slats without concomitant raising of the lower list.

Thus, said prior art device does not give the user the possibility of arbitrary adjustment of the slats by means of said control unit when the lower list is in some position between and uppermost position and a lowermost position. In relation to the above comments on Danish Pat. No. 144 894, it should be emphasized here that said patent specification exclusively deals with the stopping of the Venetian blind in an uppermost or a lowermost position and gives no indication at all regarding an adjustment of the angle of the slats in relation to a raising of lowering of said lower list.

SUMMARY OF THE INVENTION

This invention intends to obviate such drawbacks and in this respect a control device of the kind set forth in the Field of the Invention section differs from prior art in that according to the invention it comprises a control circuit so arranged as to supply current to the motor in a predetermined time interval for driving said motor at a first speed in a direction chosen by the user for a slow change of angle of the slats by means of spring clutches and, thereafter, when said slats at the elapsing of said time interval have reached one of their extreme positions, to supply the motor with a second stronger current for driving said motor at a second higher speed in order to obtain, in the direction chosen by the user, raising or lowering of the lower list of the Venetian blind by means of said spring clutches and the corresponding lift cords.

By separating the two functions, i.e., the adjustment of the slats and the raising (or lowering), from one another by means of said control circuit, the user is thus given the possibility within said predetermined interval of adjusting the angle of the slats without or practically without raising or lowering movement.

Experiments made on a window of ordinary size and with a Venetian blind of the usual type show that a time interval of a few seconds, e.g., 4 seconds, is quite sufficient for adjustment of the slats one way or the other. If within said predetermined time interval and after having obtained the desired angle position one inactivates the control circuit, the slats and the lower list will remain in their present position. On the contrary, by further activating the control circuit, one obtains the raising or lowering of the Venetian blind with said slats situated in the extreme position they attain at the end of said predetermined time interval.

BRIEF DESCRIPTION OF THE DRAWINGS

The invention is further explained hereinafter with reference to the schematic drawings, in which.

DETAILED DESCRIPTION OF THE PREFERRED EMBODIMENTS

Figure 1:
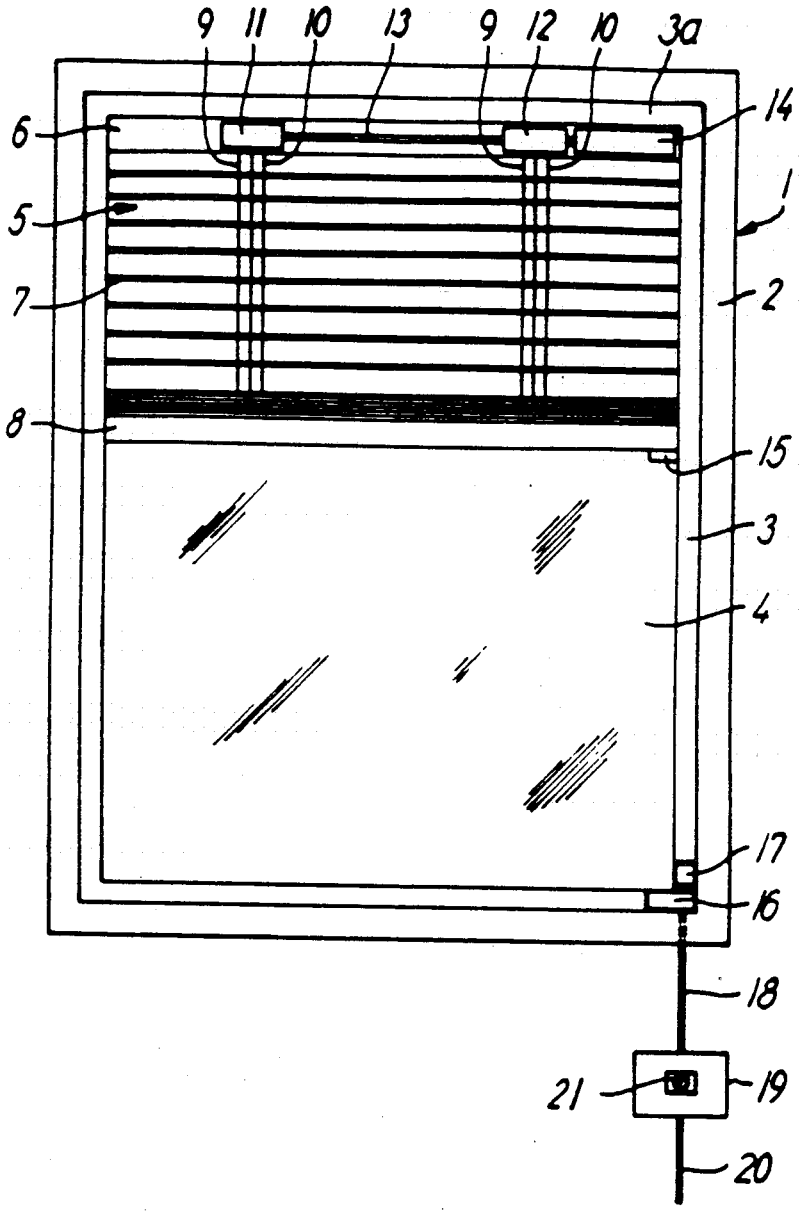
FIG. 1 shows a window with a Venetian blind and a corresponding control device according to the invention.

FIG. 1 shows a window 1 comprising a frame 2, a sash 3 and a pane 4. It can be a fixed window or a side hinged window in a vertical wall or a tiltable window in a pitched roof. The following description is made on the assumption that it is a tiltable window of the kind having hinges (not shown) fitted on the two frame and sash side parts of the window.

Reference 5 shows a Venetian blind of the usual type having a head rail 6 affixed to the uppermost transversal part 3*a* of the sash 3, a number of slats 7, a lower list 8, and matching ladder tapes 9 and lift cords 10.

Inside the head rail 6, the front side of which, i.e., the side facing the observer, having been removed for the sake of clarity, there are two built-in spring clutches 11,12 e.g., clutches such as those known in the art from the above-mentioned German Patent Specification No. 1,683,007. A common drive shaft connects said two spring clutches 11,12 with one another and with an electric motor 14, preferably a D.C. motor.

The lower list 8 supports a magnet, preferably permanent magnet 15, the function of which will be further explained later.

On the lowermost part of the frame 2 there is located an electric contact device 16 which in relation to a contact piece 17 located on the lowermost part of the sash 3 is so arranged as to ensure, when the window is closed, a supply of current to the motor 14 through wires (not shown on the drawings) which may, e.g., be wired inside the corresponding sash side part. Said contact device comprises also a time relay, the function of which will be further explained later. It should be noted that the above-mentioned combination of contact device 16, contact piece 17, and possibly also said time relay may also be located somewhere elase on the frame and the sash, e.g., in the uppermost corner of the window or at some other location on the frame and sash side parts. However, the location near the lowermost corner is most convenient in consideration of the activating of contact in relation to the completed closing movement of the window. Furthermore, said contact device 16 comprises a reed-contact (not shown) arranged so as to be activated by the permanent magnet 15 on lower list 8, the function of which will be further explained below in relation to FIG. 2.

In case the window is of a type that can be opened and in case one wishes to give the user the possibility of also adjusting the Venetian blind when the window is open, it is obvious that the current supply to the motor 14 must be designed without said combination of contact piece 17 and contact device 16, e.g. with a flexible wiring (not shown) around or near the axis of the window hinges or with gliding contacts (not shown) at the hinges.

Wires 18 connect said contact device 16 with a unit 19, which comprises the electronic control circuit described below in relation to FIG. 2 and a corresponding main transformer receiving main voltage through wires 20. It should be noted that in the installation shown here, the control unit 19 has been located in close proximity of the window 1, but if necessary said control unit may be located somewhere else in the corresponding room, remote from the window, in case one wishes a centralized remote control of the Venetian blind.

Furthermore, it should be noted that it is not necessary to use a main supply, as said electric control may also be driven by means of a battery inside control unit 19,.in which case said wires 20 may be disposed of, or from a central, remotely located battery, in which case said wires 20 transfer supply current from said central battery to said control unit 19.

Figure 2:
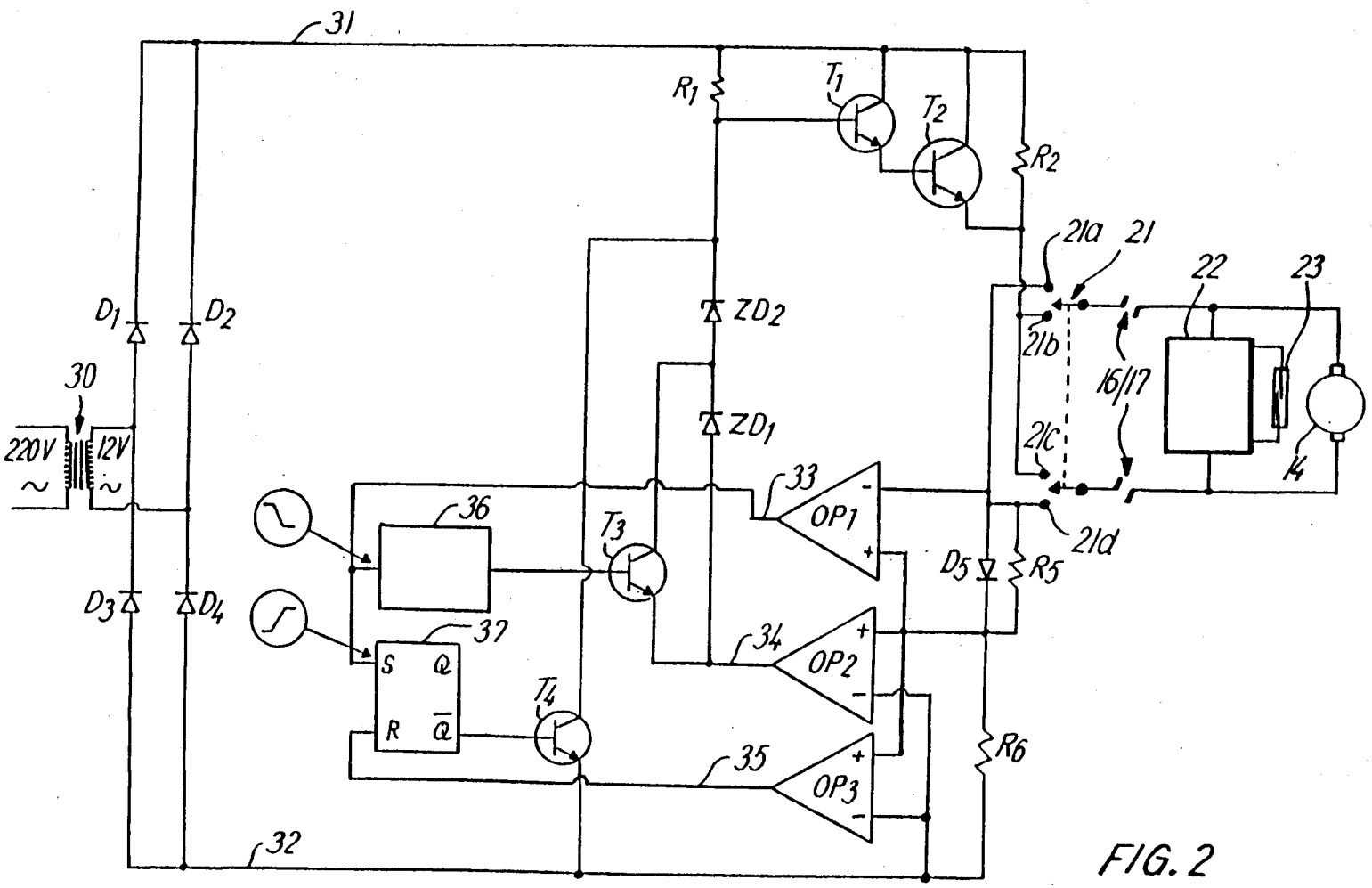
FIG. 2 shows an embodiment of an electrical control circuit for use in a control device according to the invention.

On the control unit 19 there is a three-position switch 21, the function of which will be further explained in relation to FIG. 2.

FIG. 2 shows a circuit diagram of an embodiment of a control circuit for the Venetian blind control described above. Apart from the elements already mentioned with reference to FIG. 1, i.e. the three position switch 21, which in FIG. 2 is shown in neutral middle position, the contact connection 16/17 between the frame and sash - the contact connection being established when the frame is closed - the motor 14, the previously mentioned time relay designated here by reference 22 and the reedcontact, which is here designated by reference 23, the control circuit comprises the following components.

A main transformer 30, the primary winding of which is fed with main voltage such as 220 V, 50 Hz, provides on its secondary side an AC voltage of e.g. 12 V. By means of four rectifying diodes D1–D4 of usual type, e.g. BAX18, said AC voltage is rectified into a DC voltage between two conductors 31 and 32.

An npn transistor $T_1$ e.g. of BC547-type has its collector connected with the positive conductor 31 and its base connected with said conductor 31 through a resistor $R_1$ of e.g. 4.7 kΩ. A power transistor $T_2$ of e.g. BD135-type has its collector connected with the positive conductor 31 and its base connected with the emitter of transistor $T_1$. The emitter of transistor $T_2$ is connected with a resistor $R_2$ of e.g. 1 kΩ, the opposite end of which is connected with the positive conductor 31.

The three position switch 21 as previously mentioned has a neutral position (position shown in FIG. 2) and two active positions 21*a*, 21*c* for one set of contacts and 21*b*, 21*d* for the other set of contacts, respectively.

The connecting point between the emitter of transistor $T_2$ and resistor $R_2$ is connected with contact 21*b* in the one set of contacts and with contact 21*c* of the other set of contacts, corresponding to the opposite position of the switch. Furthermore, contact 21*a* in the one set of contacts is connected with contact 21*d* of the other set of contacts, corresponding to the other position of the switch.

The circuitry combination of transistors $T_1$ and $T_2$ and resistors $R_1$ and $R_2$ described here is known per se and for persons skilled in the art it will be clearly seen that if control transistor $T_2$ is in the conducting state and if the window is closed, that is to say if a connection is established between the frame and sash through contacts 16/17 (cf. FIG. 1), a current will be delivered to motor 14 in one direction or the other, depending on the active position of switch 21 the neutral position of switch 21, motor 14 is not switched on. Said current to motor 14 circulates further through a diode $D_5$, e.g. a BAX18, in parallel with a resistor $R_5$ of e.g. 47Ω and in series with a resistor $R_6$ of e.g. 0.6Ω to return to conductor 32.

The control circuit comprises further three operational amplifiers OP1, OP2, and OP3 of a type known per se, e.g. LM 324. The connecting point between contacts 21*a*, 21*d*, anode of diode $D_5$ and resistor $R_5$ is connected with the negative input of operational amplifier OP1, the positive input of which is connected with cathode of diode $D_5$ and the corresponding end of resistor $R_5$. Depending on the nominal drive current of motor 14 and other circuit parameters, including the value of resistor $R_5$, operational amplifier OP1 works as a comparator, the output 33 of which delivers a trigger voltage, the value of which shifts from "high" when motor current I is lower than e.g. 5 mA to "low" when said motor current is higher than 5 mA.

Operational amplifier OP2 has its positive input connected with the positive input of operational amplifier OP1 and with the connecting point between cathode of diode $D_5$, resistor $R_5$ and resistor $R_6$, and also with the positive input of operational amplifier OP3. The negative input of operational amplifier OP2 and the negative input of operational amplifier OP3 are connected with return conductor 32.

Output 34 of operational amplifier OP2 is connected with the anode of a Zener-diode $ZD_1$ having a Zener-voltage of e.g. 4.7 V and with the emitter of an npn-transistor $T_3$ of e.g. BC547-type. The collector of transistor $T_3$ is connected with the cathode of Zener-diode $ZD_1$ and with the anode of a second Zener-diode $ZD_2$ having also a Zener-voltage of e.g. 4.7 V. The cathode of Zener-diode $ZD_2$ is connected with the resistor $R_1$ and with base of transistor $T_1$.

Output 33 of operational amplifier OP1 is connected with a timer 36, the output of which is connected with the base of transistor $T_3$. A conventional RS-flip-flop 37 has its control input S connected with output 33 of operational amplifier OP1 and thereby also with input of timer 36, and its R-input connected with output 35 of operational amplifier OP3, while $\overline{Q}$-output of flip-flop 37 is connected with the base of an npn-transistor $T_4$ of e.g. BC547-type. Emitter of transistor $T_4$ is connected with return conductor 32, while its collector is connected with connecting point between cathode of Zener-diode $ZD_2$, resistor $R_1$ and base of transistor $T_1$.

With the circuitry as described here, operational amplifier OP2 having a gain factor of e.g. 20 is so arranged as to perform a readjustment of the motor current. Since an AC motor is used here, and as it is known that rotation speed immediately after start of the motor tends to drop more or less depending on the charge and depending on the voltage drop over resistor $R_6$-said voltage drop depending actually on the instantaneous value of the motor current-operational amplifier OP2 serves to control the voltage on the base of transistor $T_1$ through the series combination of Zener-diodes $ZD_1$ and $ZD_2$.

The described control device functions as follows. It is assumed that the Venetian blind is in an intermediary position as shown in FIG. 1. When the user shifts switch 21 from neutral position to e.g. contacts **21*b* and 21*d*-said position may e.g. be assumed to correspond to lowering of the Venetian blind-a current goes through resistor $R_2$, motor 14 and resistors $R_5$ and $R_6$. As long as said current keeps below 5 mA, output 33 of operational amplifier OP1 activates flip-flop 37**, the $\overline{Q}$-output of which inhibits transistor $T_4$. Thus, the base of transistor $T_1$ goes high and said transistor as well as power transistor $T_2$ are made conducting, whereby the resistance value of resistor $R_2$ is reduced.

When operational amplifier OP1, working as comparator, sees that motor current exceeds the threshold value of 5 mA, it triggers timer 36, whereby transistor $T_3$ is made conducting and short-circuits Zener-diode $ZD_1$. Operational amplifier OP2 is thereby made to regulate the control voltage to be equal to the sum of Zener-voltage (e.g. 4.7 V) over Zener-diode $ZD_2$ plus output voltage of operational amplifier OP2. The motor 14 rotates now with slow speed and, by means of spring clutches 11 and 12 in top rail 6, it produces a slow changing of the angle of the slats in one direction. If the user had decided to shift switch 21 from the middle position to the other position (connection through contacts **21*a* and 21*c*) the motor 14 would rotate in the other direction and the angular position of slats 7** will slowly change the other way.

When timer 36 indicates that a predetermined time interval has elapsed, transistor $T_3$ is inhibited, whereby Zener-diode $ZD_1$ is switched on and operational amplifier OP2 drives motor 14 at the higher speed. Said time interval, which is here supposed to be of 4 sec., which shows to be quite proper for the desired adjustment of slats by the user, may of course be chosen differently, depending e.g. on the characteristics of the motor, the size and weight of the Venetian blind (smaller or larger windows), and other related parameters.

Now, when the slats, after expiration of said time interval (e.g. 4 seconds), are in one of their extreme positions, the prior art spring clutch will, by reason of its particular properties, cf. the above-mentioned DE Patent Specification No. 1,683,007, and while motor 14 is driven at increased speed, lower said lower list 8 and thereby also the remaining slats 7.

When the lower list 8 reaches its lowermost position, said permanent magnet 15 on said lower list 8 activates the previously mentioned reed-contact 23, which is located in or near the contact device 16. As can be seen from FIG. 2, reed-contact 23 is in parallel with motor 14 and it short-circuits said motor, when said lower list 8 reaches its lowermost position.

Thereby the current through resistors $R_2$, $R_5$, and $R_6$ increases. The value of resistor $R_6$ is e.g. one hundreth of the value of resistor $R_5$. In the same way as operational amplifier OP1 is in relation to resistor $R_5$, operational amplifier OP3 senses the current through resistor $R_6$. When said current - with the values given above - exceeds 0.5 A, the operational amplifier OP3 is activated and its output 35 delivers a reset signal to reset input R of flip-flop 37. Transistor $T_4$, which until now was inhibited, is thereby short-circuited, whereby the base of transistor $T_1$ receives a low voltage and the feed current to motor 14 (actually at that time to reed-contact 23) is interrupted.

If it is now assumed that the user wishes to raise the Venetian blind all the way up, he must shift switch 21 over to its other position (connection with contacts **21*a*, 21*c*). The same control process as described above occurs now, apart from the fact that motor 14 rotates the other way (and slats 7 to begin with change their angle in the other direction) until lower list 8 reaches its uppermost position. The mechanical resistance (charge) against rotation of motor results now in the current exceeding 0.5 A, whereby flip-flop 37** likewise is reset in order to the motor current.

When lower list 8 is in its lowermost position and magnet 15 activates reed-contact 23, whereby the current by-passes the motor 14, said motor is unable to rotate any more. Thereby, one would obtain a "locked" position, in which the user is not directly able to raise the Venetian blind. In order to obviate such "locking function" in the lowermost position, the control circuit comprises a timer 22, which is connected with the motor current circuit and with reed-contact 23 and which is so arranged so to define a convenient time interval of e.g. 5 sec. and to only function when motor current circulates in the direction corresponding to the lowering of the Venetian blind, whereby the reed-contact is switched off and the locking function of the magnet and reed-contact is terminated. Thereafter, the user may at any time activate the switch optionally, e.g. for adjustment of the angle of the slats and then the raising of the Venetian blind.

It should be noted that the control device described here may also be used on a non-openable window, e.g. shop window. In that case, the contact connection between sash and frame is superfluous and the contacts 16, 17 shown in FIG. 2 may be disposed of.

It should furthermore be noted that the control device described may also be used for Venetian blinds with vertical slats.

I claim:

1. In the combination of an electric control system for an electric Venetian blind and a Venetian blind having a head rail, a lower list, a plurality of slats, ladder tapes supporting the slats, lift cords connected to the lower list, and a drive mechanism including spring clutches for driving the ladder tapes, the spring clutches being associated with a drive shaft, and being movable upon rotation of the drive shaft over a limited arc and moveable relative to the drive shaft when the spring clutches reach the limit of the limited arc, and the lift cords being connected to the drive shaft for raising and lowering the lower list in response to rotation of the drive shaft, and a reversible electric motor for driving the drive shaft, the improvement comprising:

a control circuit for supplying current to the motor, said control circuit including first means for supplying a first current to the motor for a predetermined time to drive the motor at a first speed in either direction, as chosen by a user, to slowly change the angle of the slats by movement of the spring clutches, and said control circuit further including second means for supplying a second current, greater than said first current, for driving the motor at a second speed, greater than said first speed, in the direction chosen by the user, to raise or lower the lower list by means of the lift cords connected to the drive shaft.

2. The combination of claim 1, wherein said control circuit includes means for increasing the current to the motor after the elapse of a predetermined time interval, said current increasing means including a first operational amplifier connected in said control circuit to sense motor current and a timer defining said predetermined interval.

3. The combination of claim 2, wherein said control circuit includes means for regulating current to said motor at an increased level after said predetermined time interval has elapsed, said current regulating means including a second operational amplifier.

4. The combination of claim 1 or 2, wherein said control circuit includes means for interrupting the current to the motor when the lower list is in its uppermost position, said current interrupting means including another operational amplifier.

5. The combination of claim 1, wherein said control circuit includes means for interrupting current to the motor when the lower list reaches its lowermost position.

6. The combination of claim 5, wherein said current interrupting means includes a reed switch positioned adjacent the lowermost position of the lower list and a magnet mounted on said lower list and in alignment with said reed switch.

7. The combination of claim 5, wherein said control circuit includes means for suppressing said current interrupting means, said suppressing means including a time relay responsive to the lower list reaching its lowermost position to define a predetermined time interval.

8. The combination of claim 1, wherein the motor is positioned within the head rail.

9. The combination of claim 1, wherein the Venetian blind covers an openable window having a frame and a sash movable relative to the frame, and said control circuit comprises contacts positioned between the motor and a source of power, at least a first of the contacts being mounted on the frame and at least a second of the contacts being mounted on the sash, said first and second contacts being in contact with one another when the window is closed and out of contact with one another when the window is open.

* * * * *

UNITED STATES PATENT AND TRADEMARK OFFICE

CERTIFICATE OF CORRECTION

PATENT NO. : 4,706,726

DATED : November 17, 1987

INVENTOR(S) : Soren B. Nortoft

It is certified that error appears in the above-identified patent and that said Letters Patent is hereby corrected as shown below:

Column 1, line 32, "being" has been changed to --begin--;

Column 3, line 17, "elase" has been changed to --else--;

line 66, "reedcontact" has been changed to --reed-contact--;

Column 5, line 4, before "base", --the-- has been inserted;

Column 6, line 38, before "the", --interrupt-- has been inserted;

line 48, "so" (second occurrence) has been changed to --as--.

Signed and Sealed this

Thirty-first Day of May, 1988

*Attest:*

*Attesting Officer*

DONALD J. QUIGG

*Commissioner of Patents and Trademarks*